US012502585B2

(12) United States Patent
Pacha et al.

(10) Patent No.: US 12,502,585 B2
(45) Date of Patent: Dec. 23, 2025

(54) GOLF BAG WITH LEG RETENTION ASSEMBLY

(71) Applicant: PARSONS XTREME GOLF, LLC, Scottsdale, AZ (US)

(72) Inventors: Duane E. Pacha, Chandler, AZ (US); Grace E. Wilson, Phoenix, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/784,579

(22) Filed: Jul. 25, 2024

(65) Prior Publication Data

US 2024/0374971 A1 Nov. 14, 2024

Related U.S. Application Data

(63) Continuation-in-part of application No. 17/377,728, filed on Jul. 16, 2021, now Pat. No. 12,053,681.

(60) Provisional application No. 63/055,281, filed on Jul. 22, 2020.

(51) Int. Cl.
*A63B 55/57* (2015.01)
*A63B 55/40* (2015.01)

(52) U.S. Cl.
CPC ..... *A63B 55/57* (2015.10); *A63B 55/40* (2015.10); *A63B 2209/08* (2013.01)

(58) Field of Classification Search
CPC ..... A63B 55/57; A63B 55/40; A63B 2209/08
USPC ..... 248/688, 96
See application file for complete search history.

(56) References Cited

U.S. PATENT DOCUMENTS 2,282,842 A * 5/1942 Abell ..... A63B 55/00 206/315.7
3,276,804 A * 10/1966 Heppner ..... E05C 19/16 292/251.5
4,017,091 A * 4/1977 Wallen ..... A63B 55/60 280/DIG. 6

(Continued)

FOREIGN PATENT DOCUMENTS

CN 211195640 U 8/2020

OTHER PUBLICATIONS

Gatorfeet https://www.amazon.com/Golf-Bag-Stand-Replacement-Feet/dp/B00ITV8PYK/ref=sr_1_31?crid=JYLRBEGOZX4R&keywords= magnetic+golf+ replacement+feet&q id= 1701378792&s=sporting-goods&sprefix= magnetic+golf+ replacement+feet%2Csporting%2C172&sr=1-31 (Year: 2014).

*Primary Examiner* — Nkeisha Smith

(57) ABSTRACT

Examples of golf bags and methods to manufacture stand golf bags are generally described herein. A golf bag may include a body portion. A first leg and a second leg may be pivotally coupled to the body portion and moveable between a retracted position against the body portion and a deployed position away from the body portion. The first leg may couple with a first foot portion having a first leg retention portion configured to aid in retaining the first leg in the retracted position through magnetic attraction between the first leg retention portion and the body portion. The second leg may couple with a second foot portion having a second leg retention portion configured to aid in retaining the second leg in the retracted position through magnetic attraction between the second leg retention portion and the body portion. Other examples may be described and claimed.

20 Claims, 17 Drawing Sheets

(56) References Cited

U.S. PATENT DOCUMENTS

| | | | | |
|---|---|---|---|---|
| 4,522,299 | A * | 6/1985 | Clark | A63B 55/60 280/DIG. 6 |
| 4,753,446 | A * | 6/1988 | Mills | A63B 55/00 280/DIG. 6 |
| 4,852,896 | A * | 8/1989 | Mills | A63B 55/60 280/DIG. 6 |
| 5,082,218 | A * | 1/1992 | Hoffman | A63B 55/50 206/315.7 |
| 5,478,097 | A * | 12/1995 | Forma | A63B 55/60 280/DIG. 6 |
| 5,516,064 | A * | 5/1996 | Hsieh | A63B 55/50 248/688 |
| 5,934,624 | A * | 8/1999 | Suk | A63B 55/57 206/315.7 |
| 6,186,522 | B1 * | 2/2001 | Weis | A45C 13/262 280/DIG. 6 |
| 6,224,537 | B1 | 5/2001 | Shin | |
| 6,435,345 | B1 * | 8/2002 | Wang | A63B 55/57 206/315.7 |
| 6,766,905 | B1 * | 7/2004 | Chang | A63B 55/53 206/315.6 |
| 6,988,738 | B2 * | 1/2006 | Lu | B62B 5/067 280/DIG. 6 |
| 7,080,732 | B2 * | 7/2006 | Bonfanti | A63B 55/60 280/DIG. 6 |
| 7,287,765 | B2 * | 10/2007 | Murphy | B62B 3/12 206/315.3 |
| 7,303,070 | B1 * | 12/2007 | Hong | A63B 55/30 206/315.6 |
| 7,549,534 | B1 * | 6/2009 | Parpart | A63B 55/10 206/315.7 |
| 7,568,566 | B2 | 8/2009 | D'Ambrosio | |
| 7,780,002 | B2 * | 8/2010 | Manaster | A45C 13/02 150/159 |
| 7,934,729 | B2 * | 5/2011 | Murphy | A63B 55/60 280/DIG. 6 |
| 8,764,030 | B1 * | 7/2014 | Murphy | A63B 55/60 280/DIG. 6 |
| 9,302,162 | B1 | 4/2016 | Foxman | |
| 9,669,273 | B2 * | 6/2017 | Lai | A63B 55/57 |
| 10,722,769 | B1 * | 7/2020 | Kim | A63B 55/50 |
| 12,053,681 | B2 * | 8/2024 | Pacha | A63B 55/57 |
| 12,285,665 | B2 * | 4/2025 | Zhang | A63B 55/50 |
| 2003/0146602 | A1 * | 8/2003 | Lu | A63B 55/60 280/655 |
| 2004/0026279 | A1 * | 2/2004 | Miller | A63B 55/40 206/315.3 |
| 2008/0023356 | A1 * | 1/2008 | Manaster | A63B 55/00 206/315.3 |
| 2008/0047639 | A1 | 2/2008 | Fox | |
| 2009/0057180 | A1 | 3/2009 | Smeltzer | |
| 2009/0212174 | A1 * | 8/2009 | Pratt | A63B 55/57 248/97 |
| 2012/0048754 | A1 * | 3/2012 | Niedermeier | A63B 55/00 206/315.3 |
| 2016/0074722 | A1 | 3/2016 | Rogers et al. | |
| 2019/0275393 | A1 * | 9/2019 | High | A63B 55/57 |
| 2022/0023727 | A1 * | 1/2022 | Pacha | A63B 55/57 |
| 2024/0207704 | A1 * | 6/2024 | Zhang | A63B 55/57 |
| 2024/0374971 | A1 * | 11/2024 | Pacha | A63B 55/40 |

* cited by examiner

GOLF BAG WITH LEG RETENTION ASSEMBLY

CROSS REFERENCE

This application is a continuation-in-part of U.S. application Ser. No. 17/377,728, filed Jul. 16, 2021, which claims the benefit of U.S. Provisional Application No. 63/055,281, filed Jul. 22, 2020.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf bags and methods to manufacture golf bags.

BACKGROUND

Golf bags are used to carry golf clubs and accessories. Some golf bags are tube-shaped and hold a set of golf clubs and include one or more pockets for holding golf balls, tees, gloves, rain gear, and other golf related equipment and accessories. Golf bags may include an open top end that is divided into a plurality of slots to allow an individual to organize and sort a plurality of golf clubs. A stand golf bag is a golf club bag that includes a stand. The stand may include a pair of support legs that allow the golf bag to stand upright on the ground so that golf clubs within the golf bag are readily accessible. The support legs may be retractable to make the golf bag easier to carry.

Figure 1:
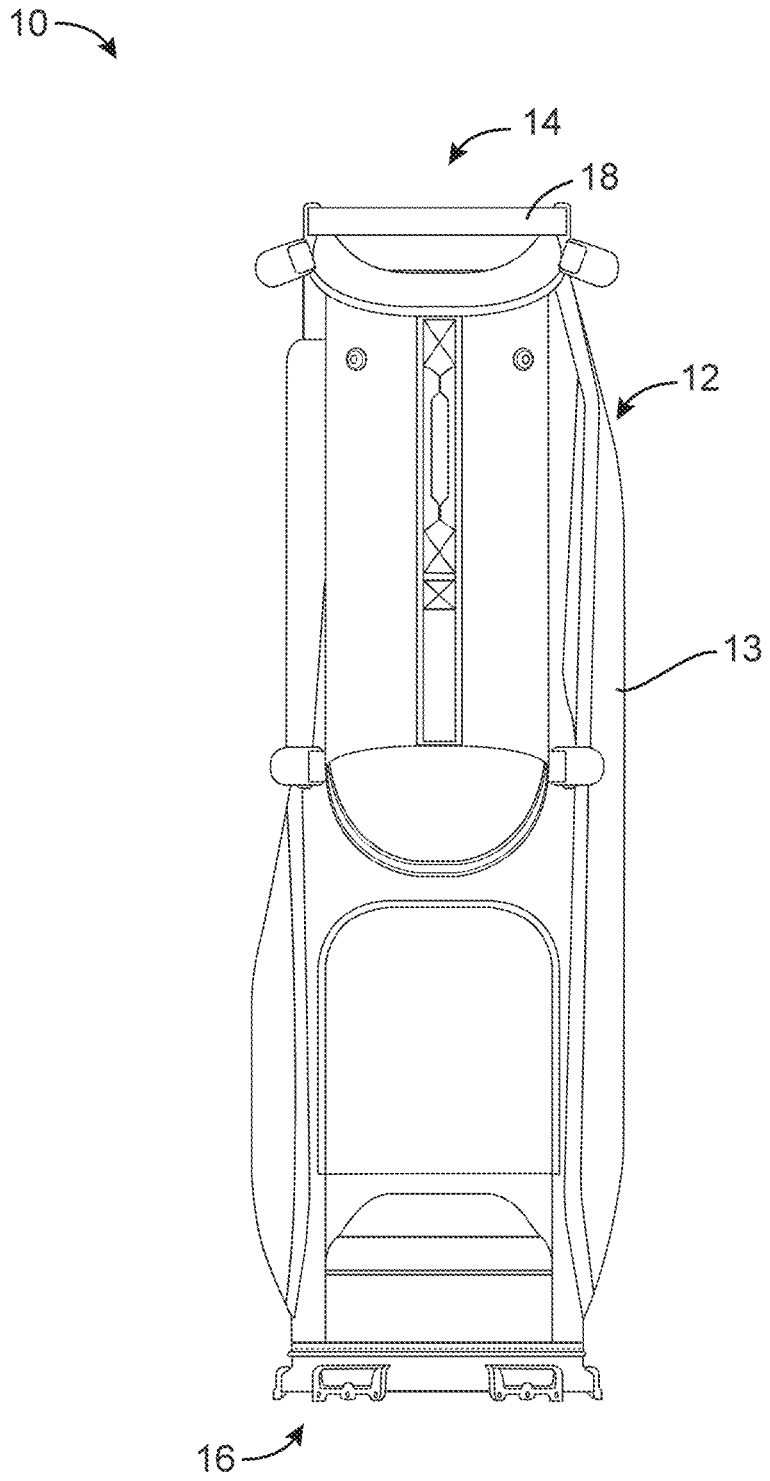
FIG. 1 depicts a front view of a stand golf bag according to an example of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club bags and methods to manufacture golf club bags are described herein. The apparatus, methods, and articles of manufacture described herein are not limited in this regard.

In the example of FIGS. 1-4, a stand golf bag 10 may include a body portion 12. The body portion 12 may be a tubular elongated body. The body portion 12 may include an open top portion 14. The body portion 12 may include a bottom portion 16. The body portion 12 may include an exterior surface 13 that extends from the bottom portion 16 to the open top portion 14. The open top portion 14 may include a divider 18 through which one or more golf clubs (not shown) may be received and at least partially stored in the body portion 12 of the stand golf bag 10. The apparatus, methods, and articles of manufacture described herein are not limited in this regard.

The stand golf bag 10 may include a retractable stand assembly 25. The retractable stand assembly 25 may include a first bracket 22 and a second bracket 24 that are pivotally coupled to a collar 20. The collar 20 may be located at or proximate to the open top portion 14 of the body portion 12. The collar 20 may be an integral part of the divider 18 or provided separately. The apparatus, methods, and articles of manufacture described herein are not limited in this regard.

The retractable stand assembly 25 may include a first leg 26 having a first end and a second end opposite the first end, and a second leg 28 having a first end and a second end opposite the first end. The first end of the first leg 26 may be coupled to the first bracket 22 and thereby pivotally coupled to the body portion 12. The first end of the second leg 28 may be coupled to the second bracket 24 and thereby pivotally coupled to the body portion 12. The first and second legs 26 and 28 may be movable between a retracted position against the body portion 12 and a deployed position away from the body portion 12. The apparatus, methods, and articles of manufacture described herein are not limited in this regard.

Figure 2:
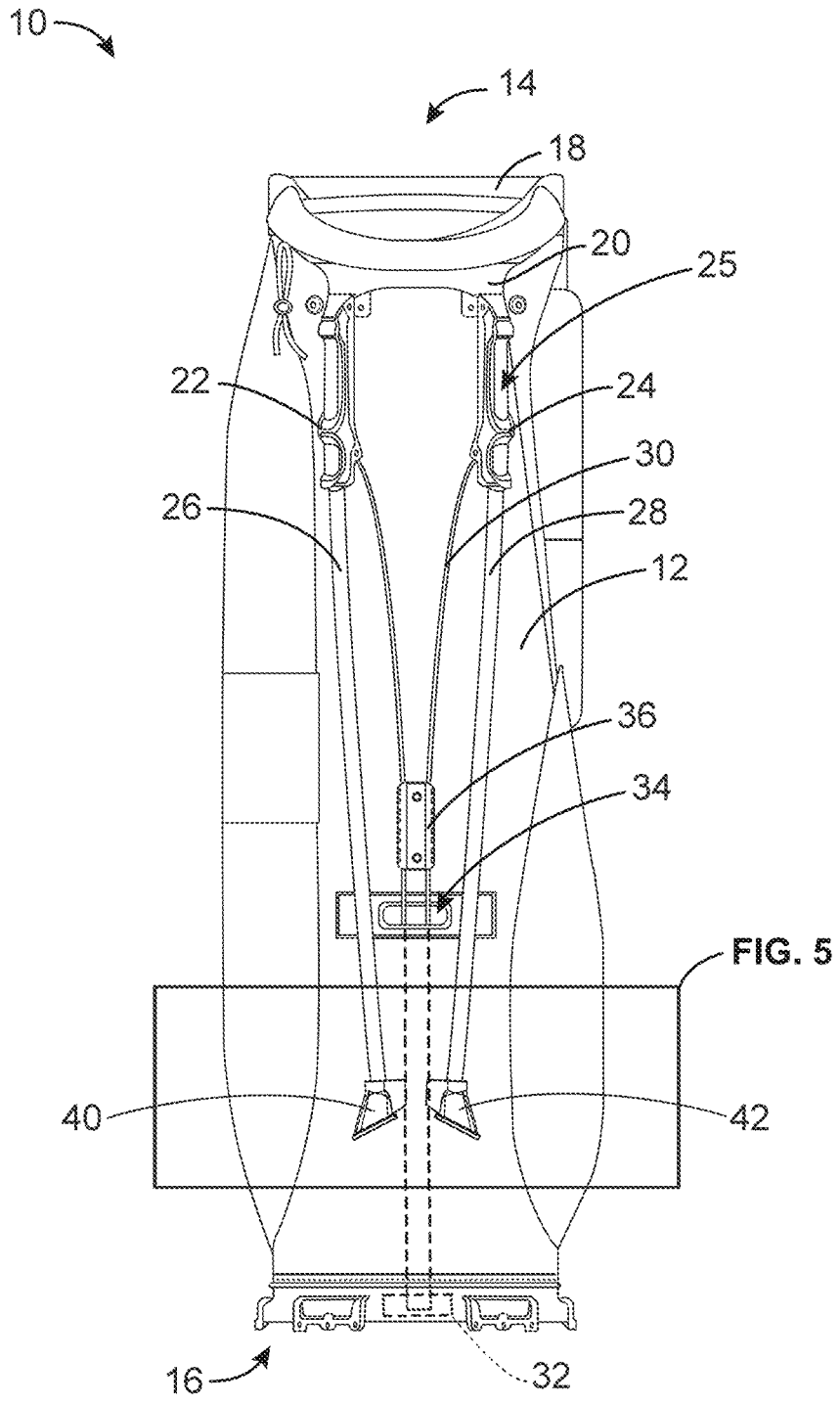
FIG. 2 depicts a rear view of the stand golf bag of FIG. 1.
Figure 3:
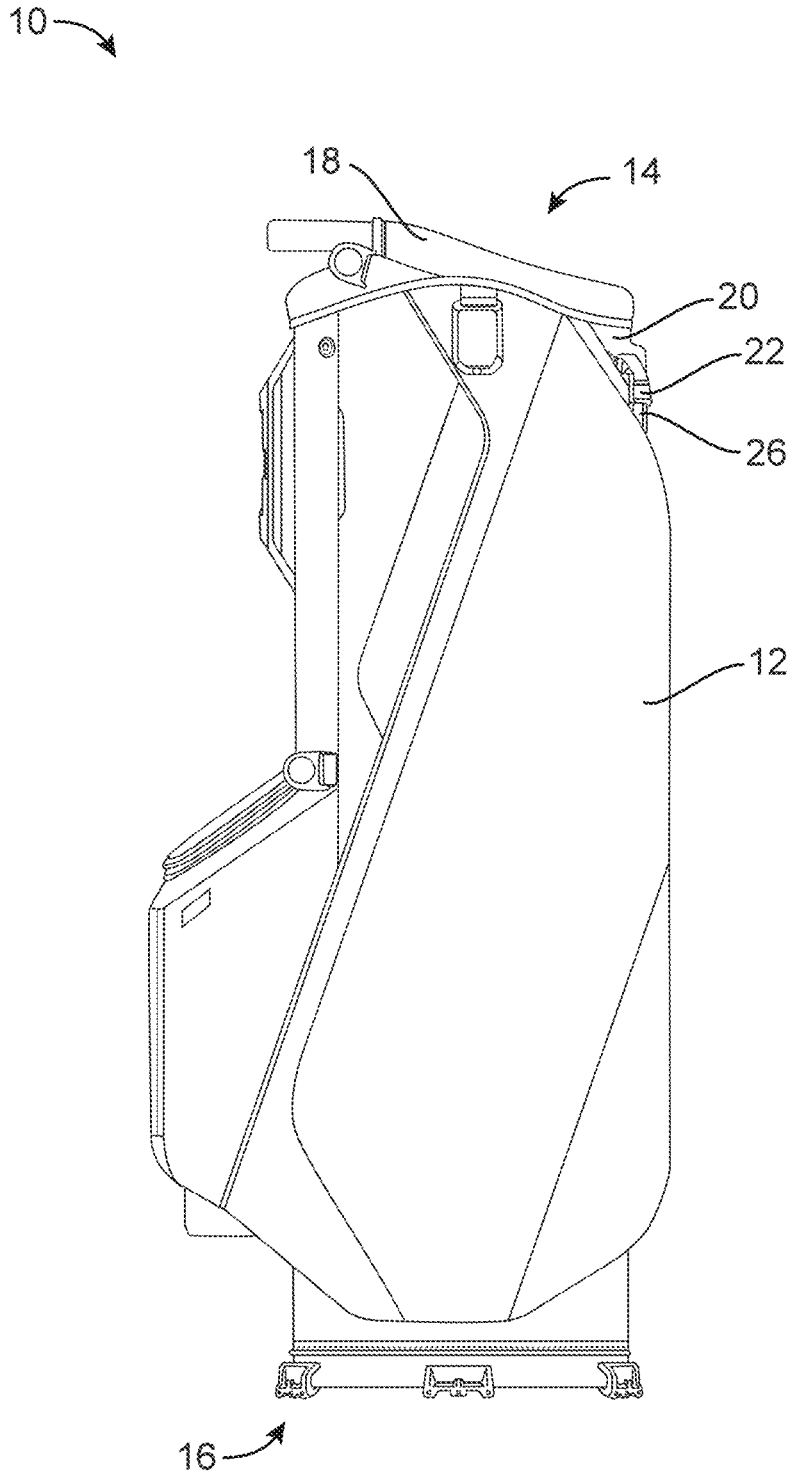
FIG. 3 depicts a left view of the stand golf bag of FIG. 1.
Figure 4:
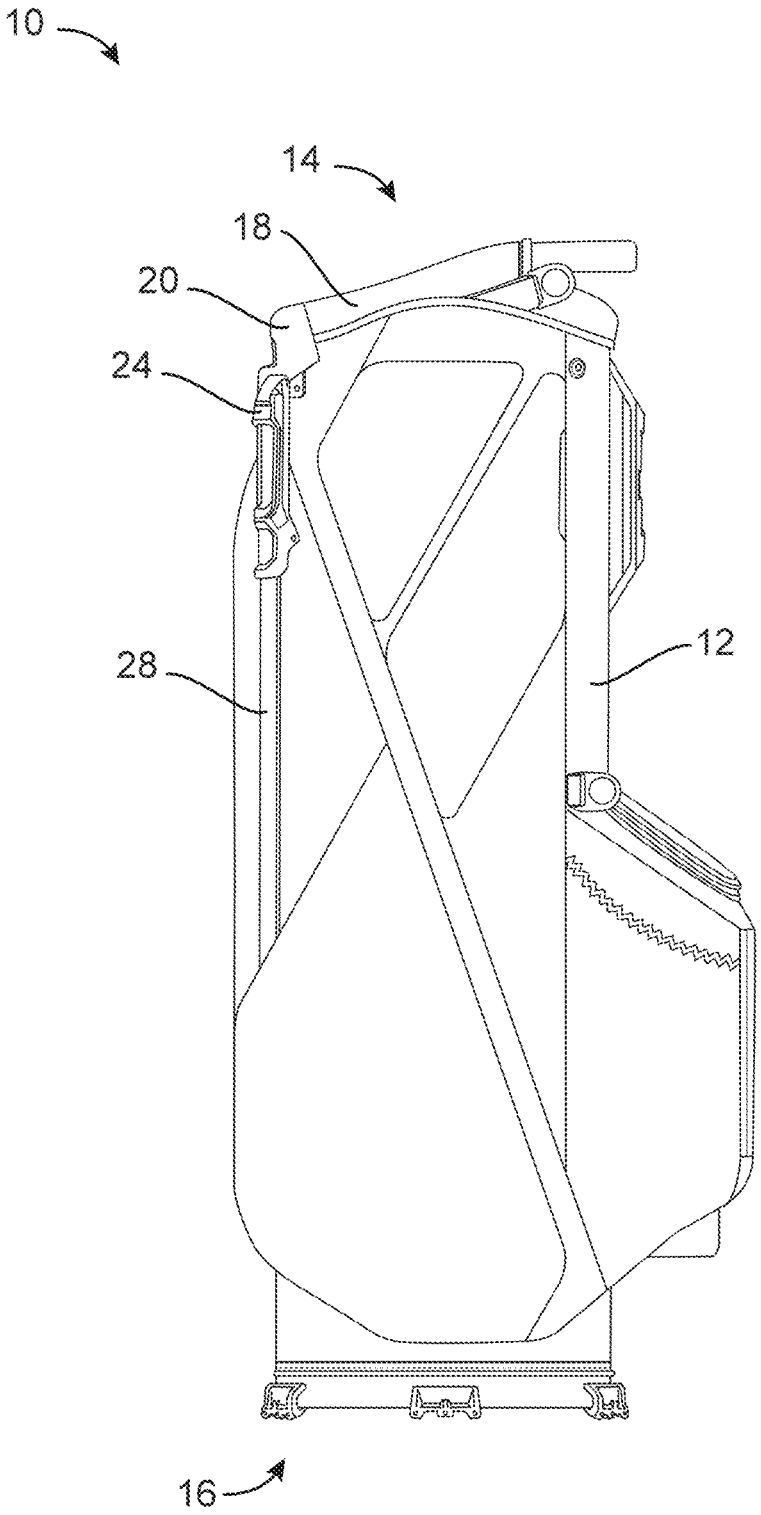
FIG. 4 depicts a right view of the stand golf bag of FIG. 1.

The retractable stand assembly 25 may include a push rod 30. The push rod 30 may be a Y-shaped push rod. The retractable stand assembly 25 may include a third bracket 32 located in the bottom portion 16. The push rod 30 may be connected to the first and second brackets 22 and 24 and be connected to the bottom portion 16 by way of the third bracket 32. Alternatively, the push rod 30 may be directly connected to the first and second legs 26 and 28 and connected to the bottom portion 16 by way of the third bracket 32. As shown in FIG. 2, a lower portion of the push rod 30 may be located within the body portion 12 and an upper portion of the push rod 30 may be located outside the body portion 12. The upper portion of the push rod 30 may extend through an opening 34 formed in the body portion 12 and extend upward to the first and second brackets 22 and 24. The push rod 30 may be a unitary or multi-piece structure made from a resilient metal material such as, but not limited to, a steel rod. The apparatus, methods, and articles of manufacture described herein are not limited in this regard.

The retractable stand assembly 25 may include a push rod retainer 36. The push rod retainer 36 may maintain the Y shape of the pushrod and retain the spring properties of the push rod 30 during deployment and retraction of the first leg 26 and the second leg 28. During deployment and retraction of the first and second legs 26 and 28, the push rod 30. When deploying the first and second legs 26 and 28, the push rod retainer 36 may prevent the push rod 30 from bowing outward from the body portion 12 (i.e., prevent expansion or excessive expansion of the Y shape of the push rod 30) and thereby aid in transferring force from the push rod 30 to the first and second brackets 22 and 24 to promote deployment of the first and second legs 26 and 28. Further, by maintaining the Y shape of the push rod 30 during deployment, the push rod retainer 36 assists in spring loading the push rod 30 for retraction of the first and second legs 26 and 28. When the golf bag 10 is picked up and carried, pressure applied to the push rod 30 by the ground surface is relieved, thereby allowing the spring force of the push rod 30 (i.e., spring loaded during deployment) to slide the push rod 30 downward and the first and second legs 26 and 28 to retract inward toward the body. The apparatus, methods, and articles of manufacture described herein are not limited in this regard.

When the stand golf bag 10 is carried or set against the ground in an upright position, the first and second legs 26 and 28 may bias toward a retracted position with the legs drawn inward against or proximate to the body portion 12. In some instances, an individual may set the stand golf bag 10 against the ground with a rearward tilt, thereby causing the push rod 30 to be pressed upward due to interaction with a ground surface and thereby transfer an upward force against the first and second brackets 22 and 24, which causes the first and second legs 26 and 28 to deploy in an outward direction about the pivot points established between the first and second brackets 22 and 24 and the collar 20. The apparatus, methods, and articles of manufacture described herein are not limited in this regard.

In one example, the retractable stand assembly 25 may include a first foot portion 40 that may be removably attached to the second end of the first leg 26, and a second foot portion 40 that may be removably attached to the second end of the second leg 28. Each of the first foot portion 40 and the second foot portion 42 may include a high friction sole, such as a rubber sole. In one example, shown in FIG. 8, the first foot portion 40 and the second foot portion 42 may include ribbed rubber soles to increase friction between the soles and the ground. In another example, the soles of first and second feet 40 and 42 may include any surface pattern to increase friction. In yet another example, the soles 43 of the first foot portion 40 and the second foot portion 42 may include spikes to penetrate the ground to secure the first leg 26 and the second leg 28 in the deployed position. In yet another example, the first foot portion 40 and the second foot portion 42 may be made from a different material than the materials of the first leg 26 and the second leg 28. The first foot portion 40 and the second foot portion 42 may be constructed from an elastic polymer material (e.g., rubber) to provide enhanced friction, stability, and/or dampening when the first leg 26 and the second leg 28 are deployed. When the first and second legs 26 and 28 are deployed, the first foot portion 40 and the second foot portion 42 may come to rest against the ground and aid in supporting the stand golf bag 10 in a tilted upright position in which the stand golf bag 10 is less prone to falling over compared to when the stand golf bag 10 is stood upright with the first and second legs 26 and 28 in a retracted position. The apparatus, methods, and articles of manufacture described herein are not limited in this regard.

To prevent the first and second legs 26 and 28 from drooping, sagging, or inadvertently deploying while the stand golf bag 10 is being carried or stood upright against the ground, the retractable stand assembly 25 may include a leg retention assembly 60 configured to retain the legs against the body portion 12. The leg retention assembly 60 may not be visible to an individual using the stand golf bag 10. The leg retention assembly 60 may include one or more magnets configured to facilitate contactless retention of the first and second legs 26 and 28 in a retracted position. The leg retention assembly 60 may not require manual actuation each time the golf bag is lifted from the ground and carried. For example, the leg retention assembly 60 may be free of any leg straps or clips that would require manual operation by an individual using the stand golf bag 10. The leg retention assembly 60 may be a hands-free leg retention system that may operate without intervention. The apparatus, methods, and articles of manufacture described herein are not limited in this regard.

Figure 5:
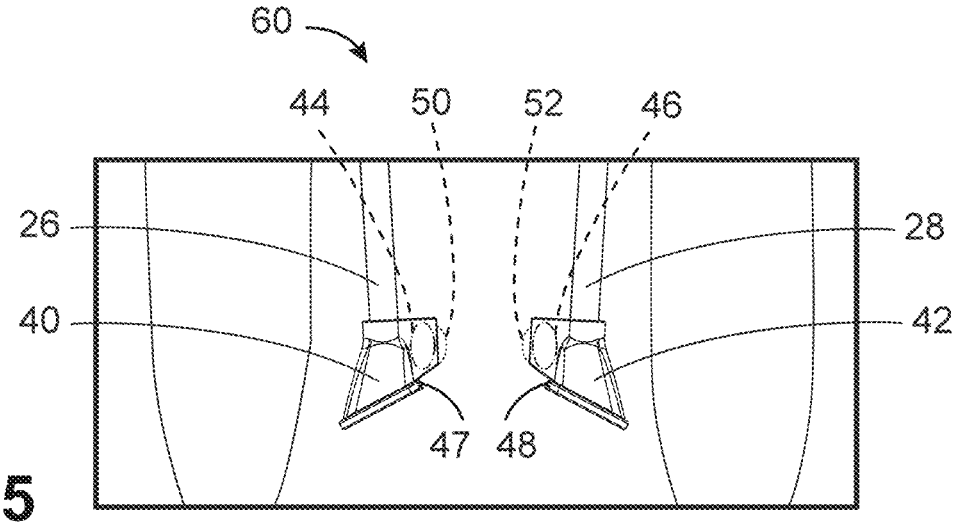
FIG. 5 depicts an enlarged view of a boxed area of the stand golf bag of FIG. 2 and illustrates an example of a leg retention assembly of the stand golf bag of FIGS. 1-4.

In the example of FIG. 5, the first foot portion 40 may include a first leg retention portion 44 that magnetically couples to the body portion 12. In one example, the first leg retention portion 44 may be a magnetic leg retention portion that magnetically attracts a metal portion within or outside the body portion 12 to retain the first leg 26 in a retracted position. In another example, the first leg retention portion 44 may be a magnetic leg retention portion that magnetically attracts and/or is magnetically attracted to another magnet within or outside the body portion 12 to retain the first leg 26 in a retracted position. In yet another example, the first leg retention portion 44 may be a metal portion that is magnetically attracted to a magnet located within or outside the body portion 12 to retain the first leg 26 in a retracted position. The first leg retention portion 44 may be disposed at any location inside or outside of the first foot portion 40. In one example, the first leg retention portion 44 may be positioned at or proximate to a first heel portion 47 of the first foot portion 40. In another example, the first leg retention portion 44 may be positioned at or proximate to a side portion of the first foot portion 40. In yet another example, the first leg retention portion 44 may be located at the second end of the first leg 26. The apparatus, methods, and articles of manufacture described herein are not limited in this regard.

In the example of FIG. 5, the second leg 28 may include a second foot portion 42. The second foot portion 42 may include a second leg retention portion 46 that magnetically couples to the body portion 12. In one example, the second leg retention portion 46 may be a magnetic leg retention portion that magnetically attracts a metal portion within or outside the body portion 12 to retain the second leg 28 in a retracted position. In another example, the second leg retention portion 46 may be a magnetic leg retention portion that magnetically attracts and/or is magnetically attracted to another magnet within or outside the body portion 12 to retain the second leg 28 in a retracted position. In yet another example, the second leg retention portion 46 may be a metal portion that is magnetically attracted to a magnet located within or outside the body portion 12 to retain the second leg 28 in a retracted position. The second leg retention portion 46 may be disposed at any location inside or outside of the second foot portion 42. In one example, the second leg retention portion 46 may be positioned at or proximate to a second heel portion 48 of the second foot portion 42. In another example, the second leg retention portion 46 may be positioned at or proximate to a side portion of the second foot portion 42. In yet another example, the second leg retention portion 46 may be located at the second end of the second leg 28. The apparatus, methods, and articles of manufacture described herein are not limited in this regard.

Figure 8:
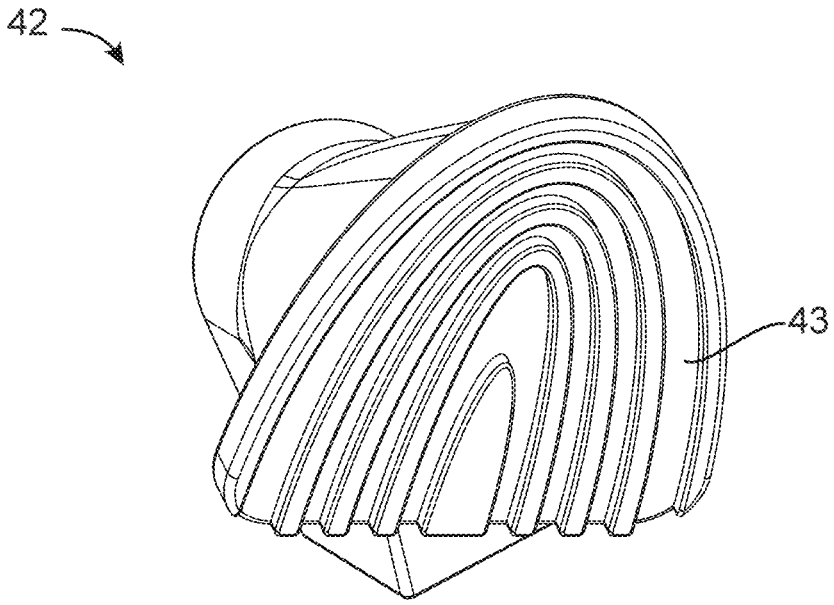
FIG. 8 shows a bottom perspective view of a foot portion of the stand golf bag of FIGS. 1-4.
Figure 9:
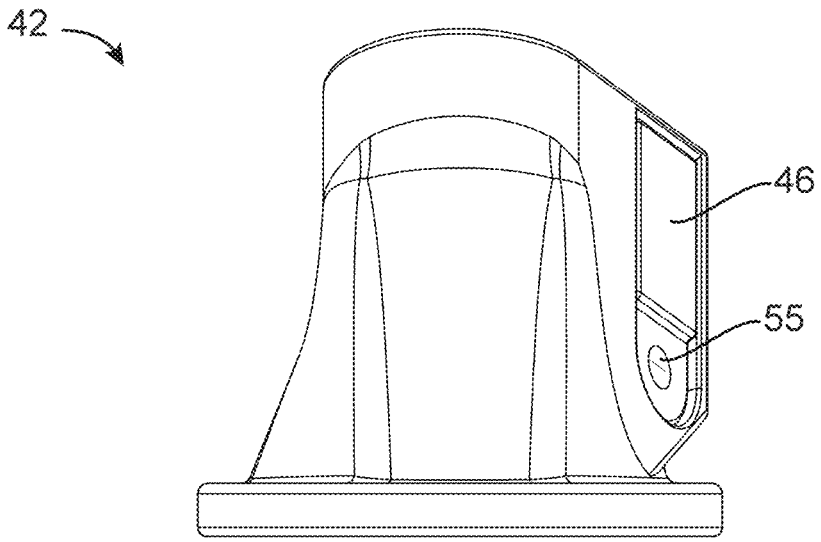
FIG. 9 shows a right side view of the foot portion of FIG. 8.
Figure 10:
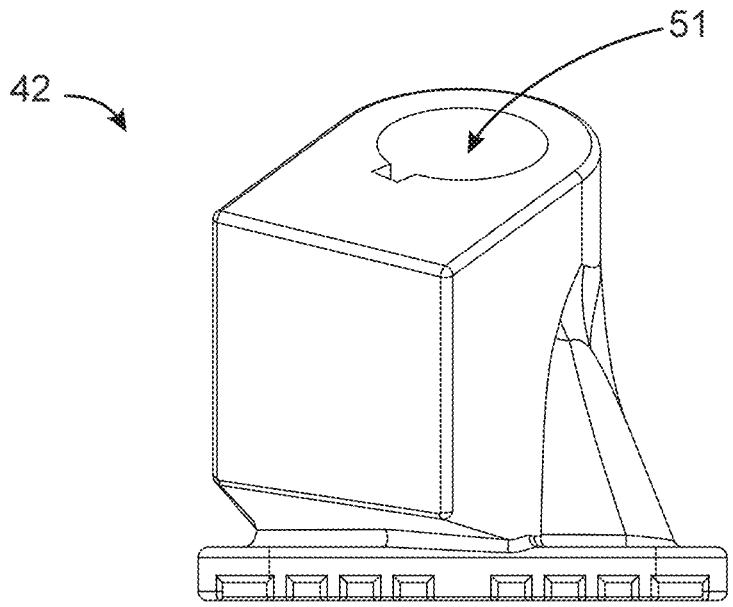
FIG. 10 shows a left side view of the foot portion of FIG. 8.
Figure 11:
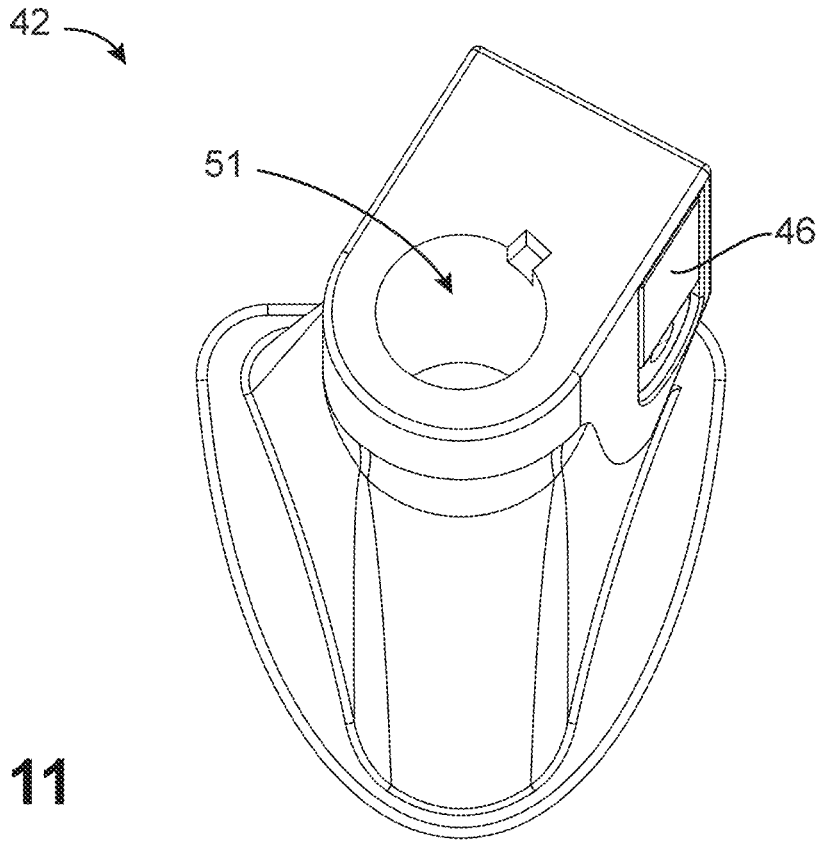
FIG. 11 shows a top perspective view of the foot portion of FIG. 8.
Figure 12:
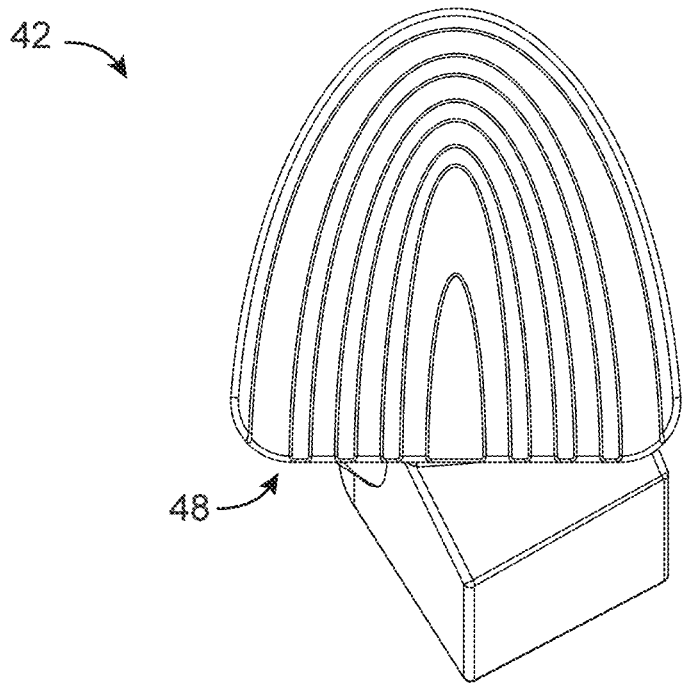
FIG. 12 shows a bottom view of the foot portion of FIG. 8.
Figure 13:
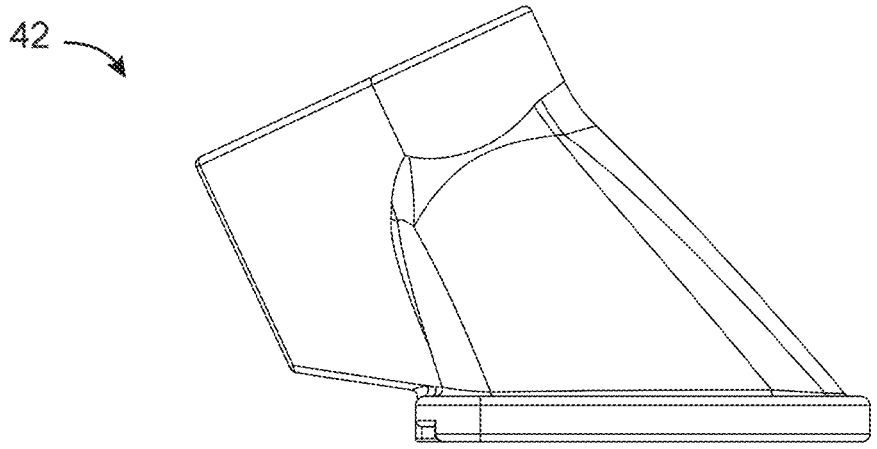
FIG. 13 shows a front view of the foot portion of FIG. 8.
Figure 14:
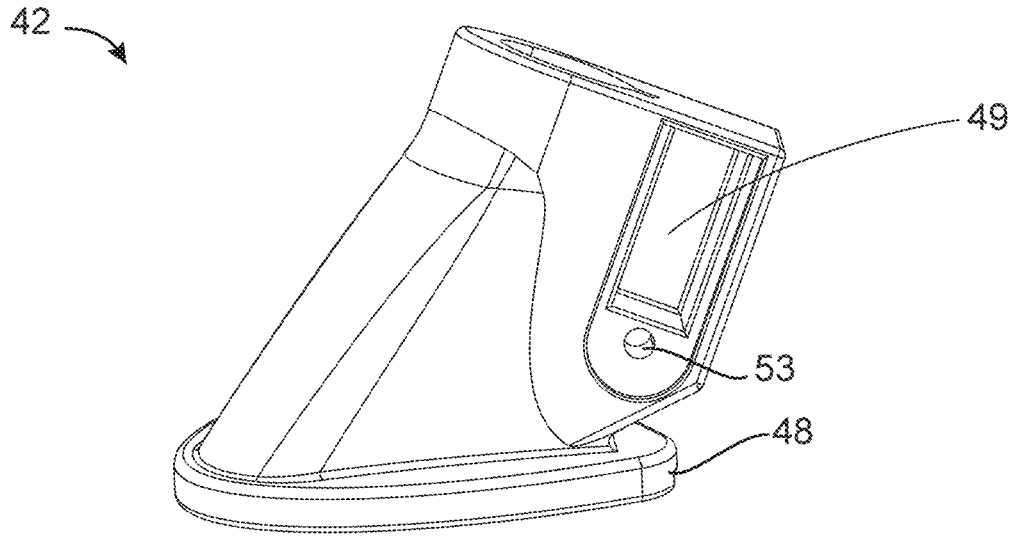
FIG. 14 shows a rear view of the foot portion of FIG. 8 with a leg retention portion removed to expose a cavity in a side portion of the foot portion.
Figure 15:
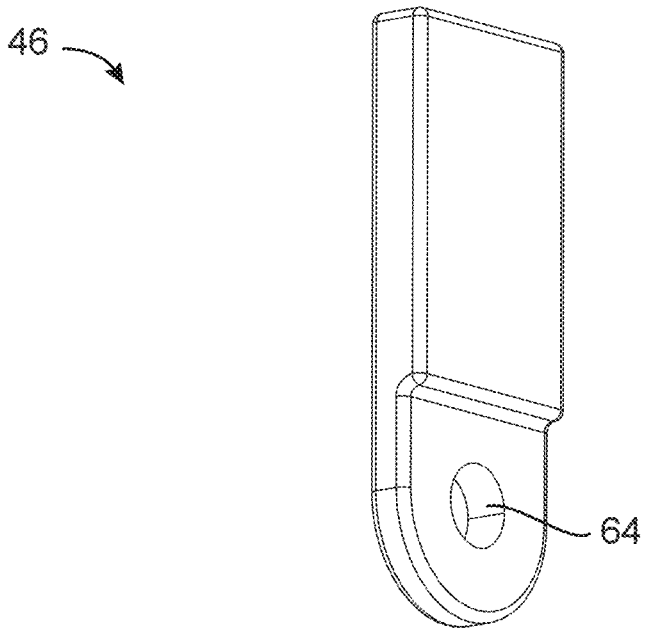
FIG. 15 shows a leg retention portion of the foot portion of FIGS. 8-14.

An example second foot portion 42 is shown in FIGS. 8-14. The first foot portion 40 may be identical or similar in many respects to the second foot portion 42. Accordingly, any properties and/or characteristics of the second foot portion 42 as described herein may equally apply to the first foot portion 40. The second foot portion 42 may include an opening 51 to receive the second end of the second leg 28. As shown in FIG. 13, for example, the second foot portion 42 may be shaped to maximize contact between the sole 43 of the second foot portion 42 and the ground when the second leg 28 is in the deployed position. Accordingly, as shown in FIG. 13, the sole 43 may have a certain angle relative to a center axis of the opening 51 to maximize contact between the sole 43 and the ground (i.e., sole 43 laying flat or substantially flat on the ground) when the second leg 28 is in the deployed position. As described herein, the first foot portion 40 and the second foot portion 42 may be made from an elastic polymer material. Accordingly, the opening 51 may have a smaller inner diameter than an outer diameter of the first leg 26 and the second leg 28 to elastically receive the corresponding second end of the first leg 26 or the second end of the second leg 28 (i.e., the opening 51 is elastically expanded to receive the first leg 26 or the second leg 28) to maintain the first foot portion 40 and the second foot portion 42 elastically attached to the first leg 26 and the second leg 28. The second foot portion 42 may include a high friction sole 43, which may include one or more structures, such as ribs as shown in FIG. 8, to enhance friction between the sole 43 and the ground. The second foot portion 42 may have a cavity 49 configured to receive the second leg retention portion 46. An example second leg retention portion 46 is shown in FIG. 15. The second leg retention portion 46 may be a magnetic insert that is mounted in the cavity 49 in the second foot portion 42. Alternately, the second leg retention portion 46 may be a metal portion that is mounted in the cavity 49 in the second foot portion 42. In one example, the second leg retention portion 46 may have a thru-hole 64 that when aligned with a threaded hole 53 in the cavity 49, cooperatively receive a fastener 55 to securely mount the second leg retention portion 46 in the cavity 49. The second leg retention portion 46 may be removably connected to the second foot portion 42 to allow the second leg retention portion 46 to be replaced with a leg retention portion having a stronger or weaker magnet depending on, for example, preference of an individual or age or condition of the retractable stand assembly 25. In another example, however, the leg retention portion 46 may be connected to the second foot portion 42 with an adhesive or other permanent or semi-permanent attachment methods. The second leg retention portion 46 may be mounted flush or recessed into the cavity 49, as shown in FIG. 11. The cavity 49 may be located at or proximate to the second heel portion 48 of the second foot portion 42. The cavity 49 may be disposed in a side portion of the second foot portion 42 to reduce a distance between the second leg retention portion 46 and the exterior surface 13 of the body portion 12 when the second leg 28 is in a retracted position. Reducing the distance between the second leg retention portion 46 and the exterior surface 13 of the body portion 12 may strengthen the magnetic attraction between the second leg retention portion 46 and a corresponding leg retention portion (e.g., a magnet or metal member) on the body portion 12. The apparatus, methods, and articles of manufacture described herein are not limited in this regard.

As described herein, the first foot portion 40 may be removably attached to the first leg 26, and the second foot portion 42 may be removably attached to the second leg 28. In one example, the first foot portion 40 and the second foot portion 42 may be removed from the first leg 26 and the second leg 28, respectively, and exchanged with another first foot portion 40 and another second foot portion 42. Accordingly, an individual may exchange the first foot portion 40 and the second foot portion 42. In one example, an individual may replace the first foot portion 40 and the second foot portion 42 due to wear and tear or damage (e.g., torn or cracked feet). In another example, an individual may replace the first foot portion 40 and the second foot portion 42 with another first foot portion 40 and second foot portion 42 having different sole frictional properties (e.g., replace feet with other feet having spikes). In another example, an individual may replace the first foot portion 40 and the second foot portion 42 for cosmetic or visual reasons (e.g., to change the color of the feet). In another example, an individual may replace the first foot portion 40 and the second foot portion 42 with larger feet to provide additional stability for the golf bag when the legs 26 and 28 are in the deployed position. In yet another example, an individual may replace the first foot portion 40 and the second foot portion 42 with feet made from different materials than the original feet, for example, to change the functional properties of the feet and/or to increase longevity of the feet. As also described herein, the leg retention portions 46 may be magnets and replaceable. Accordingly, an individual may replace the leg retention portions 46 with stronger magnets to increase the magnetic retention force of the first leg 26 and the second leg 28 against the body portion 12 and/or to prevent or reduce unintended deployment of the first leg 26 and the second leg 28. The replacement of the leg retention portions 46 with leg retention portions 46 having stronger magnets may be necessary with long term and repeated deployment and retraction of the first leg 26 and the second leg 28 due to possible reduction in the magnetic forces of the leg retention portions 46. Additionally, replacement of the leg retention portions 46 may be necessary due to wear and tear and/or damage. Thus, with the retractable stand assembly 25 having a replaceable first foot portion 40, a replaceable second foot portion 42, and replaceable leg retention portions 46 as described herein, the retractable stand assembly may be customized, modified, and/or repaired by an individual. The apparatus, methods, and articles of manufacture described herein are not limited in this regard.

As described herein, the first leg retention portion 44 may couple to a corresponding magnetic and/or metal portion on the body portion 12 to retain the first leg 26 in a retracted position, and the second leg retention portion 46 may couple to a corresponding magnetic and/or metal portion on the body portion 12 to retain the second leg 28 in a retracted position. In one example, the body portion 12 may include a first body retention portion 50, which may be a magnet or metal portion, and which may be disposed inside or outside the body portion 12 of the stand golf bag 10 and positioned to align or substantially align with the first leg retention portion 44 when the first leg 26 is in the retracted position. Likewise, in another example, the body portion 12 may include a second body retention portion 52, which may be a magnet or metal portion, and which may be disposed inside or outside the body portion 12 of the stand golf bag 10 and positioned to align or substantially align with the second leg retention portion 46 when the second leg 28 is in the retracted position. The first and second body retention portions 50 and 52 may be oriented to establish a magnetic attraction with the first and second leg retention portions 44 and 46, respectively. As a result, the magnetic attraction between the first leg retention portion 44 and the first body retention portion 50, and the magnetic attraction between the second leg retention portion 46 and the second body retention portion 52, may aid in retaining the first and second legs 26 and 28 in the retracted position and also serve to prevent drooping, sagging, or inadvertent deployment of the first and second legs 26 and 28 while the stand golf bag 10 is being carried or stood upright against the ground. The apparatus, methods, and articles of manufacture described herein are not limited in this regard.

Figure 6:
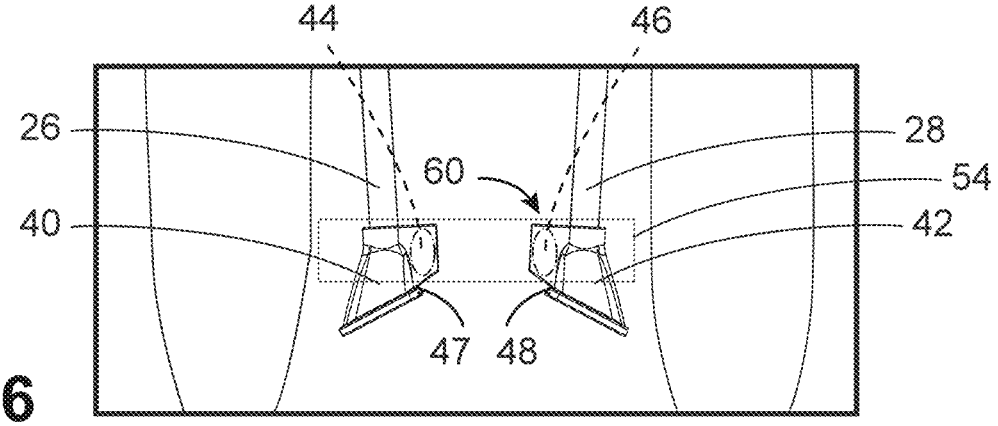
FIG. 6 depicts another example of the leg retention assembly of FIG. 5.

As described herein, the first leg retention portion 44 may couple to a corresponding magnetic and/or metal portion on the body portion 12 to retain the first leg 26 in a retracted position, and the second leg retention portion 46 may couple to a corresponding magnetic and/or metal portion on the body portion 12 to retain the second leg 28 in a retracted position. In the example of FIG. 6, the metal portions on the body portion 12 that are attracted by the first leg retention portion 44 and the second leg retention portion 46 may be defined by a metal portion 54, such as a metal plate, which may be disposed inside or outside the body portion 12 of the stand golf bag 10 and positioned to align or substantially align with the first and second leg retention portions 44 and 46 to establish a magnetic attraction therebetween when the first and second legs 26 and 28 are in the retracted position. In one example, the metal portion 54 may be a single piece and have a rectangular shape and may extend lengthwise in a lateral direction across the body portion 12 of the stand golf bag 10 as shown in FIG. 6. In another example, the metal portion 54 may be provided as multiple pieces. In another example, the metal portion 54 may instead be embodied as a single magnet oriented to establish a magnetic attraction with the first and second leg retention portions 44 and 46. In yet another example, the first and second leg retention portions 44 and 46 may instead be embodied as metal pieces, while the metal portion 54 may be a single magnetic piece or multiple magnetic pieces. The apparatus, methods, and articles of manufacture described herein are not limited in this regard.

Figure 7:
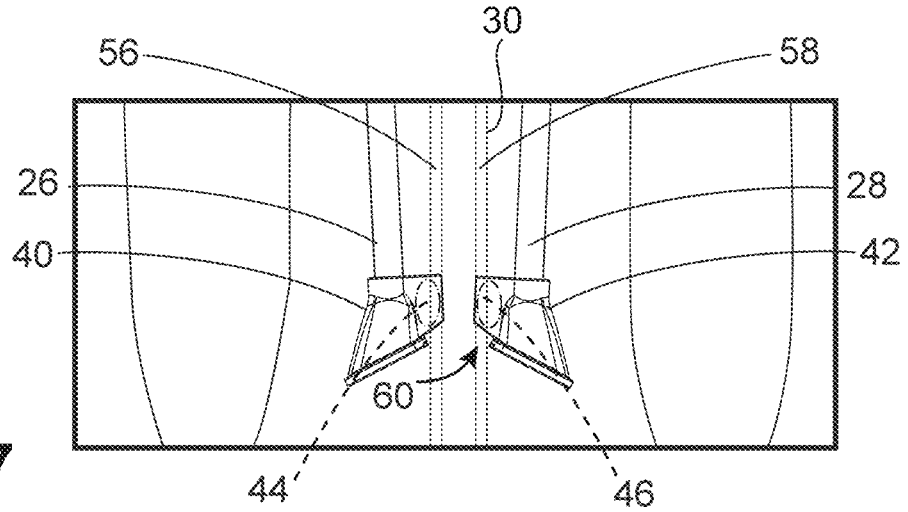
FIG. 7 depicts yet another example of the leg retention assembly of FIG. 5.

In the example of FIG. 7, the push rod 30 may be configured to align or substantially align with the first and second leg retention portions 44 and 46 to establish a magnetic attraction therebetween when the first and second legs 26 and 28 are in the retracted position. The push rod 30 may have a two-beam construction characterized by a first beam 56 and a second beam 58. The first beam 56 may connect to the first bracket 22 and align or substantially align with the first leg retention portion 44. The second beam 58 may connect to the second bracket 24 and align or substantially align with the second leg retention portion 46. The first and second beams 56 and 58 may connect with each other to form the end of the push rod 30 that is retained by the third bracket 32. The first beam 56 and the second beam 58 diverge above the push rod retainer 36 and connect to the first bracket 22 and the second bracket 24, respectively, to define a Y-shaped push rod 30 as defined herein. In another example (not shown), the first and second beams 56 and 58 of the push rod 30 may be provided as separate components. The apparatus, methods, and articles of manufacture described herein are not limited in this regard.

With respect to the example leg retention assemblies of FIGS. 5-7, the strength of the magnetic attractions between the leg retention portions may be varied based on how much leg retention is preferred. Generally, it may be preferable to select a retention level that does not overly hinder an individual from deploying the first and second legs 26 and 28. The apparatus, methods, and articles of manufacture described herein are not limited in this regard.

Figure 16:
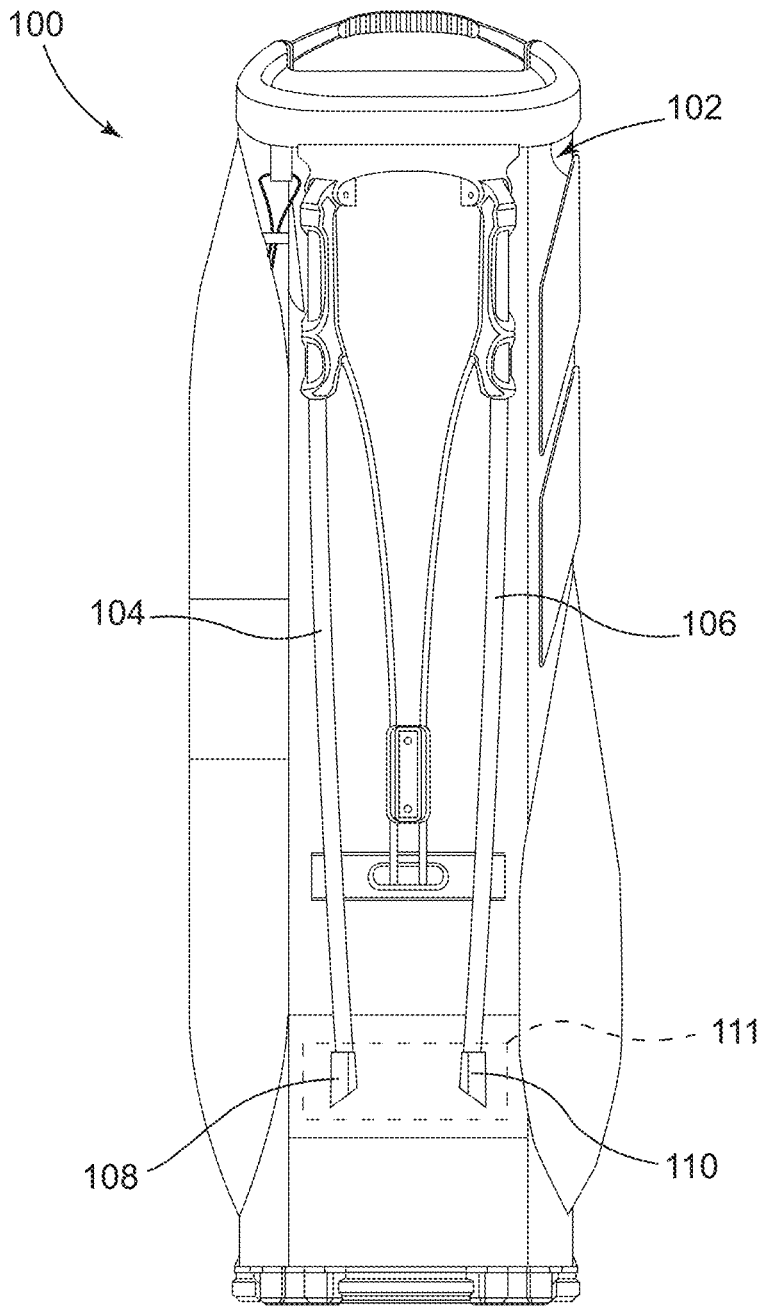
FIG. 16 shows a rear view of a stand golf bag according to an example of the apparatus, methods, and articles of manufacture described herein.
Figure 17:
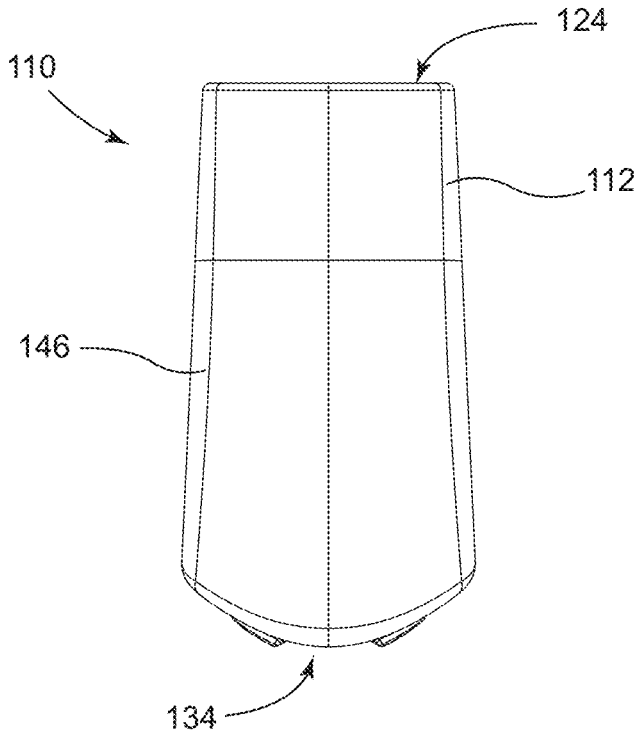
FIG. 17 is a front view of a foot portion of the stand golf bag of FIG. 16.
Figure 18:
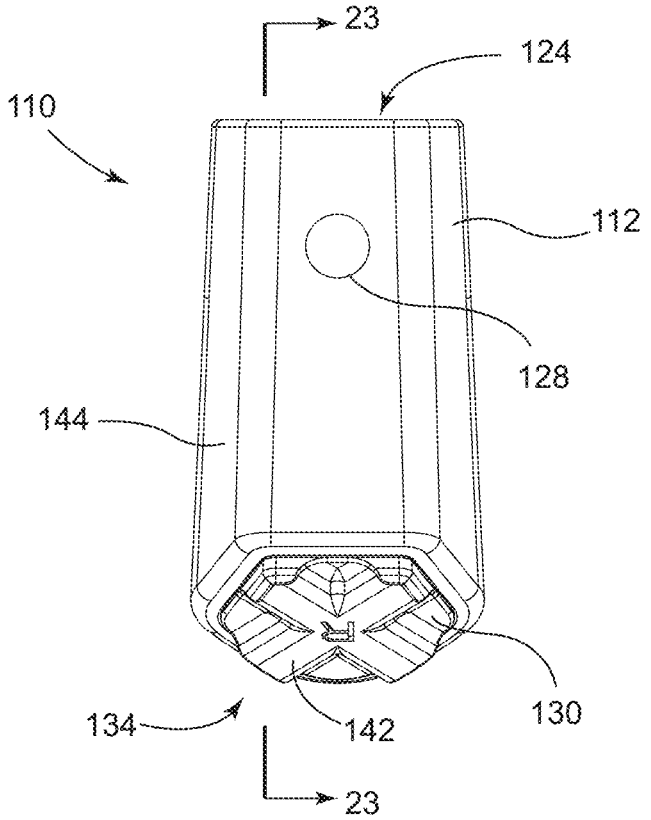
FIG. 18 is a rear view of the foot portion of FIG. 17.
Figure 19:
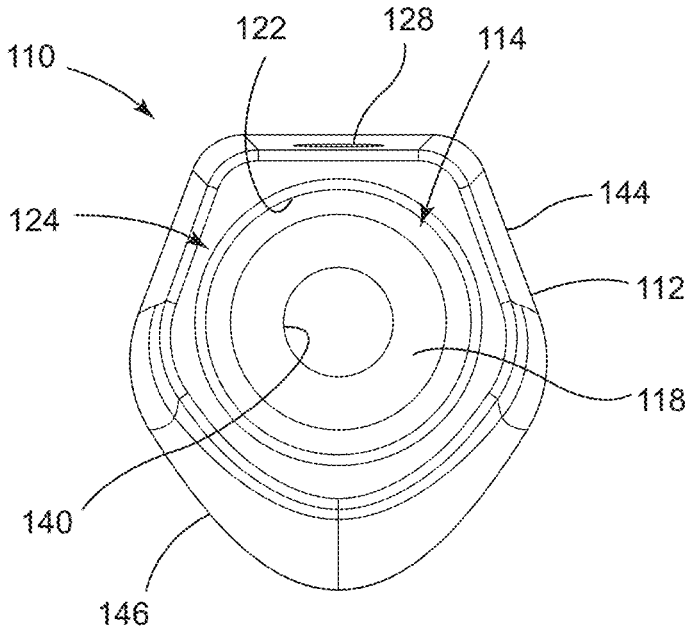
FIG. 19 is a top view of the foot portion of FIG. 17.
Figure 20:
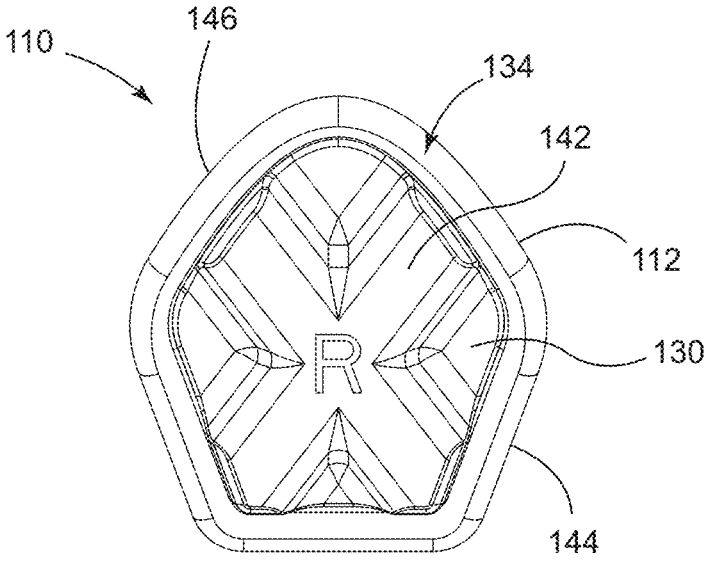
FIG. 20 is a bottom view of the foot portion of FIG. 17
Figure 21:
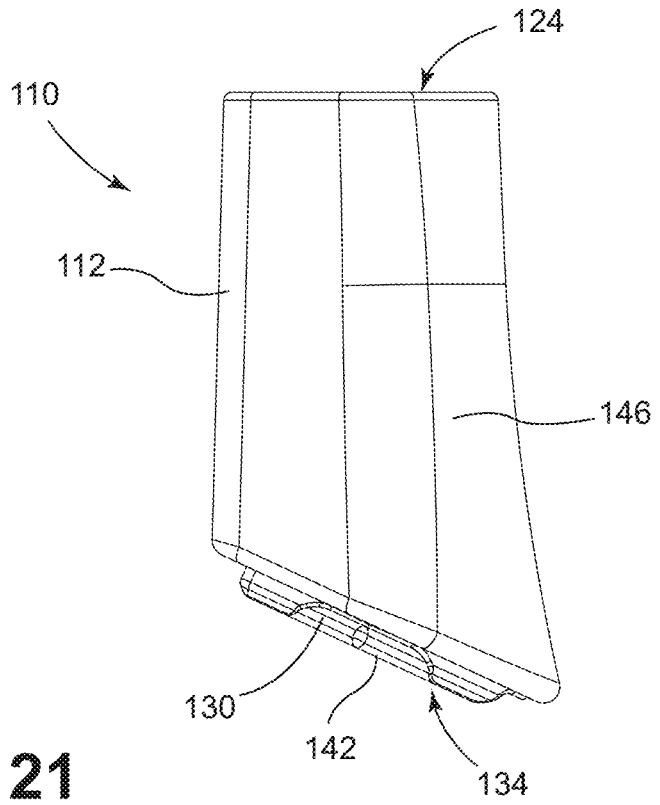
FIG. 21 is a right view of the foot portion of FIG. 17.
Figure 22:
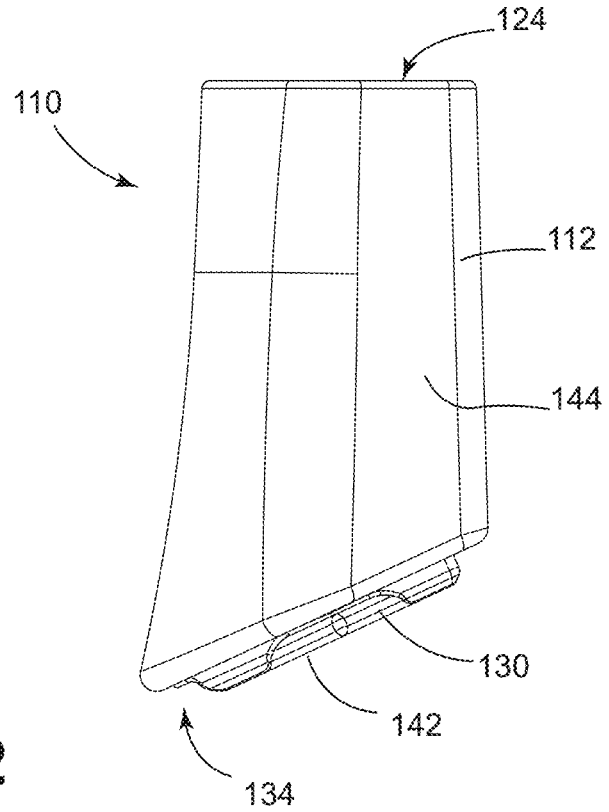
FIG. 22 is a left view of the foot portion of FIG. 17

In the example of FIG. 16, a stand golf bag 100 may include a body portion 102 and one or more legs (e.g., shown as a first leg 104 and a second leg 106) pivotally coupled to the body portion 102 and moveable between a retracted position against the body portion 102 and a deployed position away from the body portion 102 as described herein. For purposes of simplicity, the stand golf bag 100 may be identical or similar in many respects to the stand golf bag 10 described previously herein except for a first foot portion 108 and a second foot portion 110 attached to the first leg 104 and the second leg 106, respectively. The first foot portion 108 and the second foot portion 110 may be provided as alternatives to the first foot portion 40 and the second foot portion 42 described previously herein and may function similar to the first foot portion 40 and the second foot portion 40. Accordingly, the first foot portion 108 and the second foot portion 110 may releasably secure the first leg 104 and the second leg 106 in the retracted position while also stabilizing the first leg 104 and the second leg 106 in the deployed position, respectively. As described in greater detail below, the first foot portion 108 and the second foot portion 110 may each magnetically couple with a body retention portion 111 located either inside or outside of the body portion 102 to position and retain the corresponding first leg 104 and second leg 106 in the retracted position. In one example, as shown in FIG. 16, the body retention portion 111 may be a single and continuous metal plate that may be similar to the metal plate 54. In another example, each of the first foot portion 108 and the second foot portion 110 may magnetically couple to a corresponding and unique body retention portion on the body portion 102. The apparatus, methods, and articles of manufacture described herein are not limited in this regard.

An example second foot portion 110 is shown in FIGS. 17-25. The first foot portion 108 may be a mirror image of the second foot portion 110, and thus is identical or similar in many respects. Therefore, only the physical and functional features and characteristics of the second foot portion 110 are described in detail herein, with the understanding that these features and characteristics also apply to the first foot portion 108. The apparatus, methods, and articles of manufacture described herein are not limited to this configuration.

The second foot portion 110 may include a housing 112 that may be constructed from a high strength material (i.e., high tensile strength) to provide tensile and torsional strength and rigidity for statically and dynamically supporting the stand golf bag 100 when the first leg 104 and the second leg 106 are used. In one example, as shown in FIGS. 17-25, the housing 112 may be made from a high tensile strength polymer such as nylon. With a tensile strength of about 12,400 psi, nylon also has a relatively high melting point, abrasion resistance, and chemical resistance. In another example, the housing 112 may be constructed from other high-strength polymers such as polyphenylene sulfide (PPS), polyetherimide (PEI), polyamide-imide (PAI), ultra-high-molecular-weight polyethylene (UHMWPE), polycarbonate (PC), polyether ether ketone (PEEK), polyethylene terephthalate (PET), polyimide (PI), polytetrafluoroethylene (PTFE), liquid crystal polymers (LCP), polyvinylidene fluoride (PVDF), polysulfone (PSU), polyacrylonitrile (PAN), polybenzimidazole (PBI), polyarylsulfone (PAS), polyketone (PK), polyphthalamide (PPA), or polybenzoxazole (PBO). In another example, the housing 112 may be constructed from one or more composite materials such as fiberglass-reinforced polymer (FRP) or carbon fiber-reinforced polymer (CFRP). In another example, the housing 112 may be constructed from a metal or metal alloy such as aluminum. In yet another example, the housing 112 may be constructed from wood or wood based composite materials. The apparatus, methods, and articles of manufacture described herein are not limited in this regard.

Figure 23:
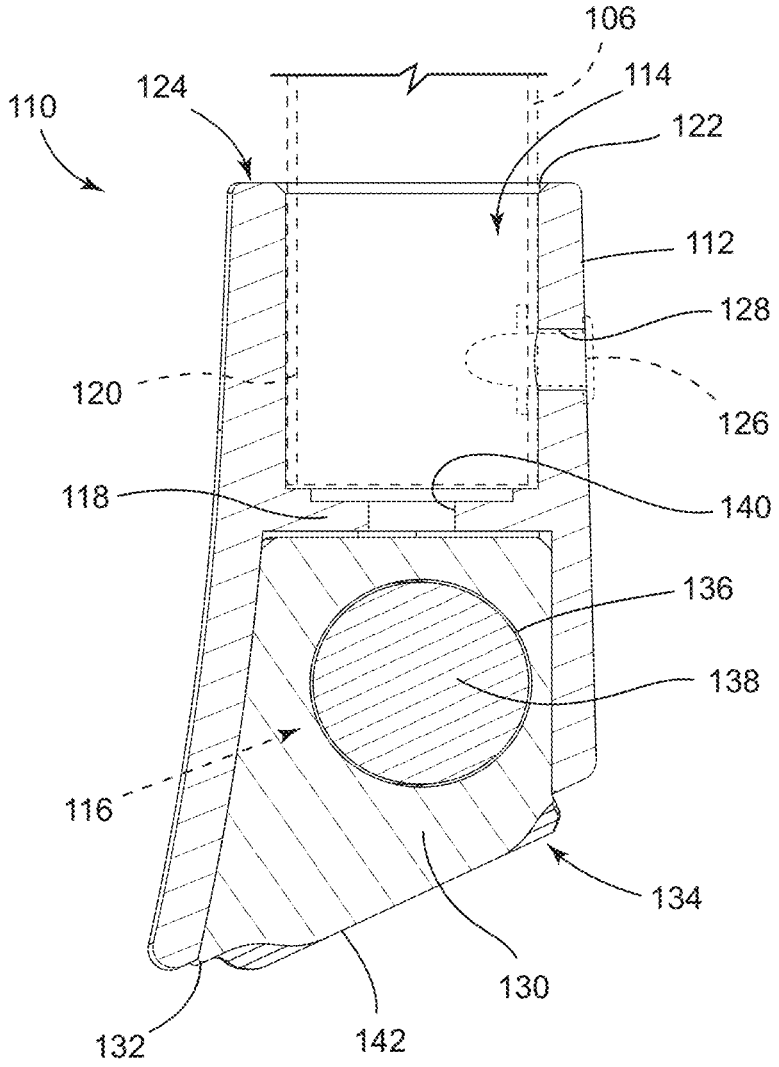
FIG. 23 is a cross-sectional view of the foot portion taken along line 23-23 of FIG. 18.
Figure 24:
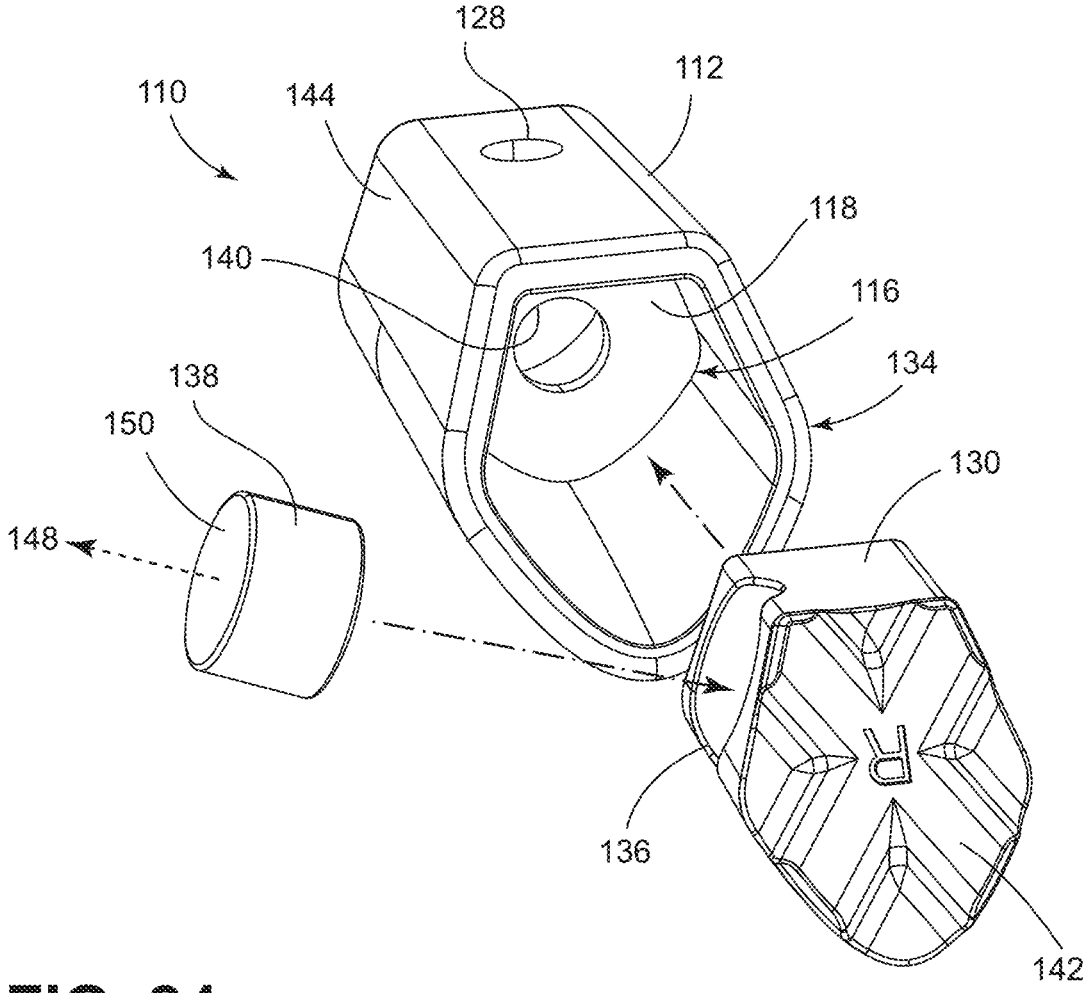
FIG. 24 is an exploded bottom perspective view of the foot portion of FIG. 17.
Figure 25:
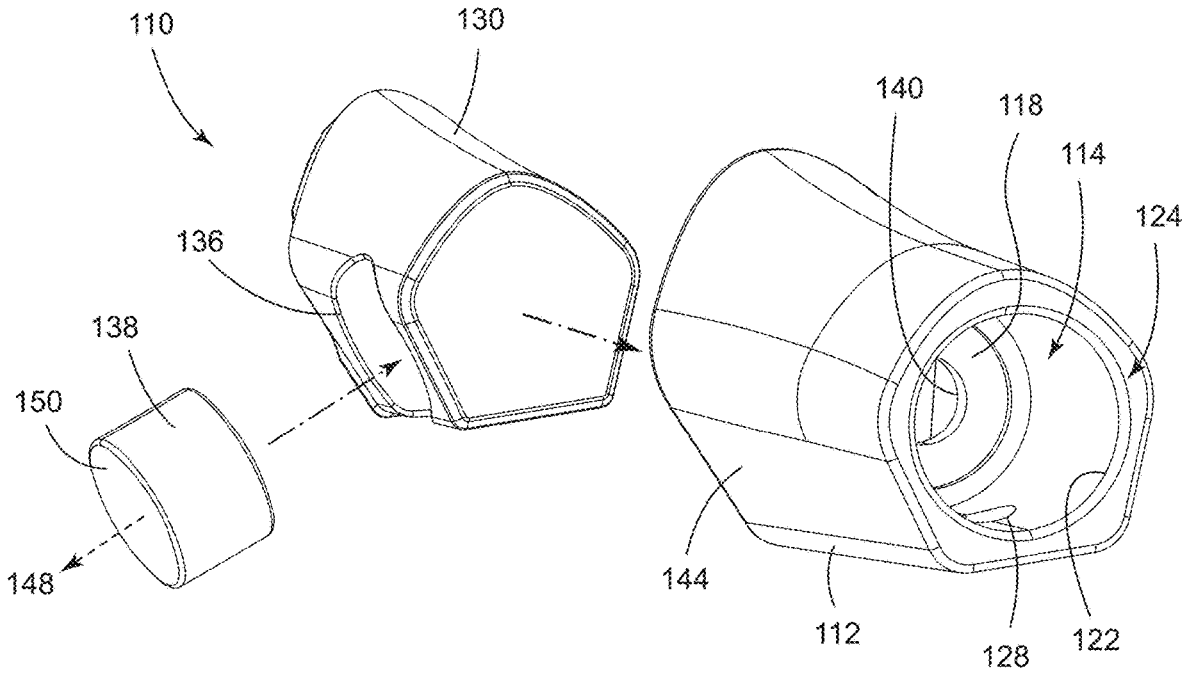
FIG. 25 is an exploded top perspective view of the foot portion of FIG. 17.

In one example, as shown in FIGS. 17-25, the housing 112 may include a first compartment 114 and a second compartment 116. The first compartment 114 and the second compartment 116 may be separated from each other by a divider 118 extending within the housing 112. The housing 112 may be configured in a stacked orientation where the second compartment 116 may be located beneath the first compartment 114. Accordingly, in one example as illustrated in FIGS. 17-25, the first compartment 114 may correspond to an upper compartment and the second compartment 116 may correspond to a lower compartment. In another example, the first compartment 114 and the second compartment 116 may be arranged in a side-by-side configuration. The first compartment 114 may be configured to receive a portion (e.g., shown in FIG. 23 as end portion 120) of the second leg 106 via an opening 122 at a top end 124 of the housing 112. In one example, one or more mechanical fasteners may be used to couple the second foot portion 110 to the second leg 106 via a side opening 128 in the housing 112. For example, as illustrated in FIG. 23, a rivet 126 may be used to couple the second foot portion 110 to the second leg 106 via the side opening 128. In another example, one or more adhesives may be used to couple the second foot portion 110 to the second leg 106. In yet another example, both one or more mechanical fasteners and one or more adhesives may be used to couple the second foot portion 110 to the second leg 106. The second compartment 116 may be configured to receive an insert 130 via an opening 132 at a bottom end 134 of the housing 112. The insert 130 may include a cavity 136 for receiving a leg retention portion 138. In one example, the insert 130 may be coupled to the second compartment 116 with one or more mechanical fasteners (e.g. one or more rivets, screws, and/or nut and bolts). In another example, as illustrated in FIG. 23, an adhesive may be used to couple the insert to the second compartment 116. In yet another example, one or more mechanical fasteners and one or more adhesives may be used to couple the insert to the second compartment 116. The apparatus, methods, and articles of manufacture described herein are not limited in this regard.

In one example, as illustrated in FIGS. 17-25, the divider 118 may define a through-port 140 to enable excess adhesive to flow out of the second compartment 116 into the first compartment 114. The excess adhesive may couple the end portion 120 of the second leg 106 to the first compartment 114. In one example, only the excess adhesive may be used to couple the end portion 120 of the second leg 106 to the first compartment. In another example, as illustrated in FIG. 17-25, the excess adhesive may be used in conjunction with the rivet 126 or one or more mechanical fasteners to further secure the second foot portion 110 to the second leg 106. In yet another example, the through-port 140 may be omitted such that the divider 118 completely separates the first compartment 114 from the second compartment 116. When assembled to the housing 112, the insert 130 may be flush with or protrude from the second compartment 116. Alternatively, the insert 130 may be recessed into the second compartment 116. The apparatus, methods, and articles of manufacture described herein are not limited in this regard.

As illustrated in FIGS. 17-25, the insert 130 may define an exterior surface of the second foot portion 110. In one example, the insert 130 may at least partially define a sole 142 of the second foot portion 110. The sole 142 may be textured to enhance friction between the sole 142 and the ground, thereby providing the second foot portion 110 with an exterior gripping surface for preventing the second foot portion 110 from slipping when the second leg 106 is in the deployed position. To provide sufficient elasticity, friction, and wear resistance for the non-slip/gripping function of the sole 142, in one example, the insert may be made from one or more polymer materials such as various types of rubber-type materials, polyurethane, silicone rubber, thermoplastic elastomers, ethylene vinyl acetate, nitrile butadiene rubber, styrene-butadiene rubber, polyvinyl chloride, chloroprene rubber, ethylene propylene diene monomer, polybutadiene rubber, thermoplastic polyurethanes, acrylonitrile butadiene styrene, polyisoprene (natural rubber), fluoroelastomers, thermoplastic vulcanizates, and hydrogenated nitrile butadiene rubber, and polyether block amide. In another example, the insert may be made from one or more metal, composite, and/or natural materials such as wood and provided with certain surface texture or pattern to provide a ground gripping function as described herein. In yet another example, the insert 130 may be constructed from any of the materials described herein. The apparatus, methods, and articles of manufacture described herein are not limited in this regard.

As described herein, the leg retention portion 138 of the second foot portion 110 may be magnetically coupled to a shared body retention portion 111 as described herein or a corresponding body retention portion 111 to releasably secure the second leg 106 in the retracted position. In one example, the leg retention portion 138 may be a magnet that magnetically attracts the body retention portion 111, which may be located either inside or outside the body portion 102. In another example, the leg retention portion 138 may be a magnet that magnetically attracts and/or is magnetically attracted to the body retention portion 111, which may be another magnet located either inside or outside of the body portion 102. In yet another example, the leg retention portion 138 may be a metal portion that is magnetically attracted to the body retention portion 111, which may be a magnet located either inside or outside of the body portion 102. In the illustrated example, the leg retention portion 138 may be disposed closer to a proximal side 144 of the housing 112 than a distal side 146 of the housing 112. The proximal side 144 of the housing 112 may correspond to a side of the housing 112 that contacts the body portion 102 when the second leg 106 is in the retracted position whereas the distal side 146 of the housing may correspond to a side of the housing 112 that is opposite to the proximal side 144 and does not contact the body portion 102 when the second leg 106 is in the retracted position. Accordingly, the cavity 136 may be disposed in a side of the insert 130 to reduce a distance between the leg retention portion 138 of the second foot portion 110 and the body retention portion 111 when the second leg 106 is in the retracted position. Reducing the distance may strengthen the magnetic attraction between the leg retention portion 138 and body retention portion 111. In one example, the leg retention portion 138 may be a disk magnet that is axially magnetized, that is, having a magnetic axis or magnetization direction 148 that runs in an axial direction with respect to the disk magnet. In this configuration, the cavity 136 may be configured to complementarily receive and orient the disk magnet such that the corresponding magnetization direction 148 points toward the proximal side 144 of the housing, and by extension, toward body retention portion 111 when the second leg 106 is in the retracted position. In other examples, the cavity 136 may be similarly configured to complimentarily receive and orient other magnet types (e.g., disk magnet having diametrical magnetization) such that their corresponding magnetization directions point toward the proximal side 144 and body retention portion 111 when the second leg 106 is in the retracted position. Alternatively, with respect to examples where the leg retention portion 138 is a metal portion, the cavity 136 may be configured to complimentarily receive and orient the metal portion to present a larger or maximum surface area (e.g., flat circular face 150) to magnetically couple with a magnet located either inside or outside of the body portion 102. The apparatus, methods, and articles of manufacture described herein are not limited in this regard.

As described herein, in one example, the first foot portion 108 and the second foot portion 110 may be mirror images of each other. Accordingly, to distinguish the first foot portion 108 from the second foot portion 110, each foot portion may include a unique identifier. In one example, the sole 142 or other area of the second foot portion 110 may include an identifier exemplarily shown as the capital letter "R" to designate the second foot portion 110 as the right foot when the stand golf bag 100 is viewed from the perspective of FIG. 16. While not shown, the sole or other area of the first foot portion 108 may include the capital letter "L" identifier to designate the first foot portion 108 as the left foot when viewing the stand golf bag 100 from the perspective of FIG. 16. In this manner, the first foot portion 108 and the second foot portion 110 may be provided preassembled and correctly installed to the corresponding first and second legs 104 and 106, respectively, such that the corresponding leg retention portions are in proper magnetic alignment with body retention portion 111. The apparatus, methods, and articles of manufacture described herein are not limited in this regard.

With respect to any of the example magnets described herein, the magnetic strength of the example magnet may be varied based on how much leg retention is preferred. Generally, it may be preferable to select a retention level that does not overly hinder an individual from deploying the corresponding legs. For instance, any example magnet described herein may have a pull force greater than or equal to 6.8 pounds and less than or equal to 10.2 pounds. Additionally or alternatively, any example magnet described herein may be a neodymium (e.g., N52) magnet or other high strength magnet. The apparatus, methods, and articles of manufacture described herein are not limited in this regard.

Figure 26:
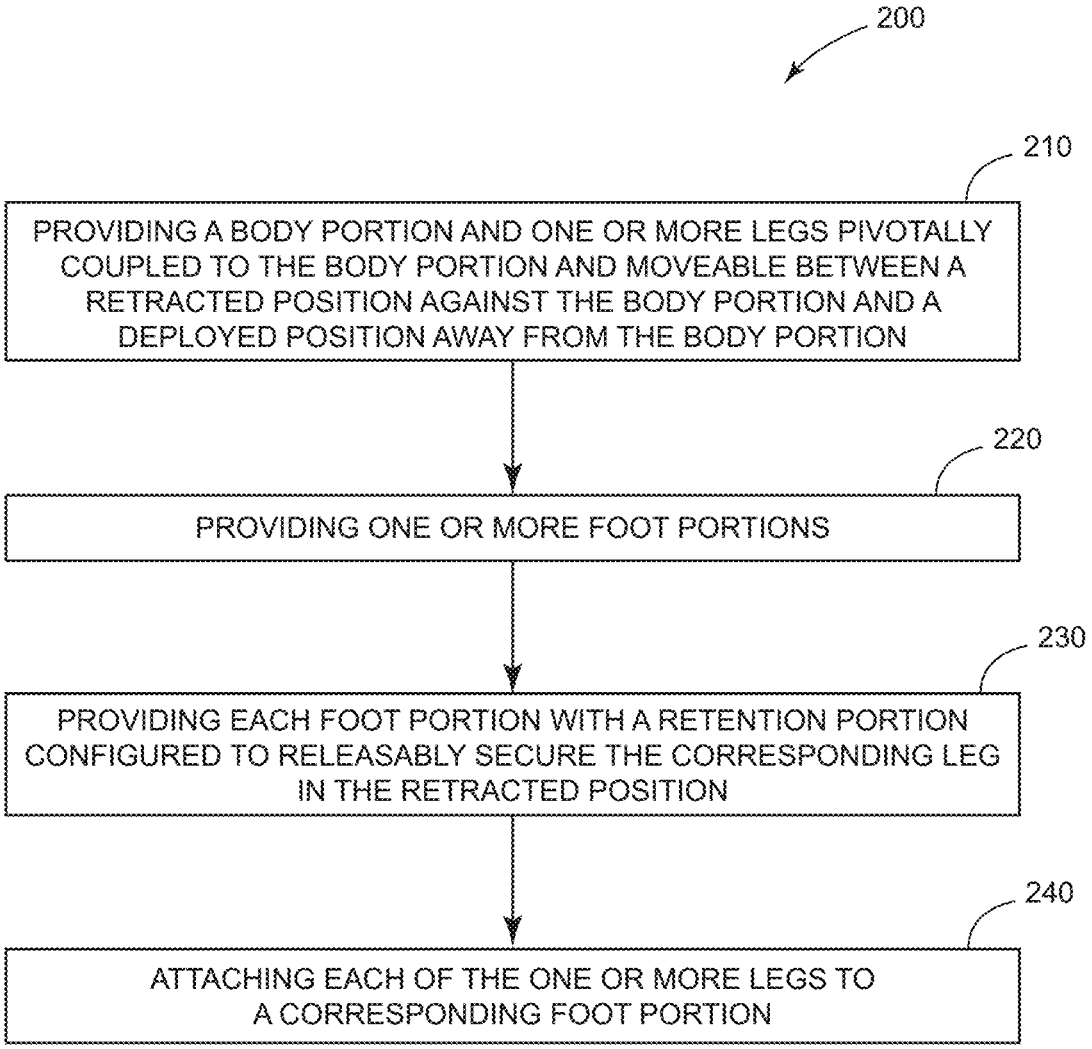
FIG. 26 is process for manufacturing a stand golf bag according to an embodiment of the apparatus, methods, and articles of manufacture described herein.

FIG. 26 depicts a process 200 by which the stand golf bags 10 and 100 described herein may be manufactured. In the example of FIG. 26, the process 200 may include providing a body portion and one or more legs pivotally coupled to the body portion and moveable between a retracted position against the body portion and a deployed position away from the body portion (block 210). The process may include providing or forming one or more foot portions as described herein (block 220). The process may also include providing each foot portion with a retention portion configured to releasably secure the corresponding leg in the retracted position as described herein (block 230). The process may further include attaching each of the one or more legs to a corresponding foot portion (block 240). With respect to the process 200 described herein, it will be understood that a given retention portion may be provided to a corresponding foot portion either before or after the corresponding foot portion is attached to a leg. Accordingly, any foot portion described herein may be preassembled with a retention portion before attachment to a leg, or alternatively, the foot portion may be first attached to the leg and the retention portion may be subsequently provided to the foot portion. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled." and any variation thereof, refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent." "close." "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf bag comprising:

a body portion configured to receive at least one golf club;

a first leg pivotally coupled to the body portion and moveable between a retracted position against the body portion and a deployed position away from the body portion;

a second leg pivotally coupled to the body portion and moveable between a retracted position against the body portion and a deployed position away from the body portion; and a first foot portion coupled to the first leg and a second foot portion coupled to the second leg, each of the first and second foot portions comprising:

a first compartment configured to receive a portion of a corresponding first or second leg;

a second compartment;

a divider separating the first compartment from the second compartment; and an insert in the second compartment, the insert comprising a leg retention portion configured to position the corresponding first leg or second leg in the retracted position through magnetic attraction between the body portion and either the first foot portion or the second foot portion.

2. A golf bag as defined in claim 1, wherein the second compartment is located beneath the first compartment, and wherein the second compartment is accessible via a bottom opening of a corresponding first foot portion or second foot portion.

3. A golf bag as defined in claim 1, wherein at least one of the first foot portion or the second foot portion is secured to the corresponding first leg or second leg by a mechanical fastener.

4. A golf bag as defined in claim 1, wherein the divider comprises a port connecting the first compartment and the second compartment, wherein the insert is secured to the second compartment using an adhesive, and wherein the port enables any excess adhesive to flow into the first compartment.

5. A golf bag as defined in claim 1, wherein the leg retention portion includes a magnet that is contained within a cavity formed in the insert.

6. A golf bag as defined in claim 1, wherein a portion of the insert defines an exterior surface of a corresponding first foot portion or second foot portion.

7. A golf bag as defined in claim 1, wherein a portion of the insert is textured to provide an exterior gripping surface to a corresponding first foot portion or second foot portion.

8. A golf bag comprising:

a body portion configured to receive at least one golf club;

a leg pivotally coupled to the body portion and moveable between a retracted position adjacent to the body portion and a deployed position away from the body portion; and a foot portion coupled to the leg, the foot portion comprising:

a housing made of a first material and configured to receive a portion of the leg; and an insert made of a second material different than the first material and coupled to the housing, the insert comprising a leg retention portion configured to pull the foot portion to the body portion for the leg to be in the retracted position, wherein the housing receives the portion of the leg via an opening located at a top portion of the housing, and wherein the housing receives the insert via an opening located at a bottom portion of the housing.

9. A golf bag as defined in claim 8, wherein the first material comprises a nylon material.

10. A golf bag as defined in claim 8, wherein the leg retention portion includes a magnet, and wherein the insert comprises a cavity containing the magnet.

11. A golf bag as defined in claim 8, further comprising a mechanical fastener configured to secure the foot portion to the leg via a side opening in the housing.

12. A golf bag as defined in claim 8, wherein the second material comprises a high friction material and defines an exterior ground contact surface of the foot portion.

13. A golf bag as defined in claim 8, wherein a portion of the insert is textured to provide an exterior gripping surface to the foot portion.

14. A golf bag comprising:

a body portion configured to receive at least one golf club;

a metallic portion located either inside or outside of the body portion;

a plurality of legs pivotally coupled to the body portion and moveable between a retracted position against the body portion and a deployed position away from the body portion; and a plurality of foot portions, each foot portion coupled to a corresponding leg of the plurality of legs, each foot portion comprising:

a housing configured to receive a portion of the corresponding leg of the plurality of legs; and a leg retention portion disposed within the housing, the leg retention portion including a magnet that pulls the metallic portion so that the corresponding leg is in the retracted position, wherein the leg retention portion is disposed closer to a proximal side of the housing than a distal side of the housing, wherein the proximal side corresponds to a side of the housing that contacts the body portion when the corresponding leg is in the retracted position, and wherein the distal side corresponds to a side of the housing that is opposite to the proximal side.

15. A golf bag as defined in claim 14, wherein the magnet comprises a disk magnet that is oriented within the housing such that a flat circular face of the disk magnet is aligned with the proximal side of the housing.

16. A golf bag as defined in claim 14, further comprising a plurality of mechanical fasteners, each mechanical fastener configured to secure a foot portion to the corresponding leg via a side opening in the housing.

17. A golf bag as defined in claim 14, further comprising an insert received in the housing, wherein the insert comprises a cavity configured to receive and orient the magnet such that a corresponding magnetization direction of the magnet points toward the proximal side of the housing.

18. A golf bag as defined in claim 14, wherein the magnet comprises a pull force greater than or equal to 6.8 pounds and less than or equal to 10.2 pounds.

19. A golf bag as defined in claim 14, wherein the housing is secured to the corresponding leg by a rivet.

20. A golf bag as defined in claim 14, wherein the housing is secured to the corresponding leg via an adhesive.

* * * * *